US005942974A

United States Patent [19]

Pfreundschuh et al.

[11] Patent Number: 5,942,974

[45] Date of Patent: Aug. 24, 1999

[54] DOOR GASKET RESISTANCE BASED INTRUSION ALARM SYSTEM

[75] Inventors: George Pfreundschuh, Bridgewater; Mark Dombrowski, Flanders, both of N.J.

[73] Assignee: Lucent Technologies, Inc., Murray Hill, N.J.

[21] Appl. No.: 09/069,333

[22] Filed: Apr. 29, 1998

[51] Int. Cl.[6] ..... G08B 13/08

[52] U.S. Cl. ..... 340/545.6; 174/35 GC; 340/539

[58] Field of Search ..... 340/545.6, 652, 340/660, 539; 455/90; 324/71.1; 174/35 GC; 361/818, 724; 312/223.1

[56] References Cited

U.S. PATENT DOCUMENTS

| | | | |
|---|---|---|---|
| D. 278,058 | 3/1985 | Larson | D14/68 |
| 4,643,333 | 2/1987 | Martin | 220/345 |
| 4,691,195 | 9/1987 | Sigelman et al. | 340/545 |
| 4,891,626 | 1/1990 | Neuman | 340/547 |
| 5,070,319 | 12/1991 | Scuka | 340/388.4 |
| 5,194,691 | 3/1993 | McIlwraith | 174/35 GC |
| 5,262,588 | 11/1993 | Gallagher | 174/35 R |
| 5,774,053 | 6/1998 | Porter | 340/568 |
| 5,798,485 | 8/1998 | Rohde et al. | 174/35 R |

*Primary Examiner*—Thomas J. Mullen, Jr.
*Attorney, Agent, or Firm*—Dickstein Shapiro Morin & Oshinsky, LLP

[57] ABSTRACT

The invention relates to an intrusion detection system which monitors the resistance of an outdoor equipment cabinet door gasket. The resistance of the door gasket is measured by a circuit to determine the integrity of the gasket and to determine whether the door has been tampered with.

30 Claims, 4 Drawing Sheets

DOOR GASKET RESISTANCE BASED INTRUSION ALARM SYSTEM

BACKGROUND OF THE INVENTION

1. Field of the Invention

The present invention relates to the general field of intrusion detection and monitoring circuitry which monitors the opening of a door. In particular, the present invention relates to such a system for monitoring the gasket resistance of a door of an outdoor electrical equipment cabinet to determine unauthorized access to the cabinet.

2. Description of the Related Art

Due to the recent explosion of the cellular industry, there is an ever increasing need for security in cellular systems. Cellular base stations often include equipment which is located outdoors. This equipment is typically stored in metal cabinets sealed by hinged doors. These cabinets are usually locked, but it is not impossible for individuals to gain access to the contents of these cabinets without the knowledge of the cellular service provider. In order to monitor these cabinets, there are currently provided intrusion detection systems. These intrusion detection systems are usually monitored from a remote location, such as a cellular switching station.

The typical intrusion detection systems for detecting door opening currently in use include a plunger and microswitch arrangement. A plunger and microswitch are attached to the door or portion of the cabinet at a location near the hinges, so that when the cabinet door is opened the plunger is no longer depressed against the microswitch, and the microswitch is turned on (using a normally "on" type microswitch). The "on" condition of the microswitch is typically wired into either a landline or a cellular radio contained within the cabinet. In the wireless cellular embodiment, an associated antenna sends a signal from the cellular base station to the cellular switching station or other remote location, identifying that the door has been opened. When the door is closed the plunger engages the microswitch and turns the switch off, and hence, no signal is transmitted via the radio and antenna to the cellular switching station. By this method, the operator at a cellular switching station can determine if there has been unauthorized access to the cellular equipment located at the base station.

Most outdoor telecommunications cabinets also include an electromagnetic interference (EMI) gasket lining the space between the door and the cabinet. These gaskets serve to limit the amount of EMI entering into and escaping from the telecommunications cabinet. Indeed, the Federal Communications Commission (FCC) has certain requirements on EMI levels, and these gaskets meet those requirements. Because the gasket is conductive, it also provides electrical continuity between the door and the cabinet.

The typical microswitch-plunger intrusion detection systems are deficient in that they cannot detect tampering with the door if the door has not been fully opened. For instance, one could pry the upper or lower portion of the door away from the cabinet without disturbing the microswitch and plunger. Further, traditional intrusion detection systems cannot measure the integrity of the EMI door gasket. Since the gasket is fashioned to prevent leakage of electromagnetic interference, monitoring of the integrity of the gasket is also useful in determining the amount of EMI leakage.

SUMMARY OF THE INVENTION

The present invention is designed to provide an EMI gasket which, in addition to providing EMI shielding, can be used to detect intrusion attempts. The EMI gasket can be monitored by a circuit to determine the gasket integrity. Partial or full interruption of the contact between the door and the gasket changes the net gasket resistance. By monitoring the net gasket resistance, an operator can determine: 1) if the door of the cabinet has been tampered with, and 2) whether the gasket is operating at its optimum EMI efficiency.

Also, by utilizing the resistance monitoring circuitry, the plunger-microswitch assembly can be eliminated, and the overall device cost can be lowered.

The above and other advantages and features of the present invention will be better understood from the following detailed description of the preferred embodiments of the invention which is provided in connection with the accompanying drawings.

DETAILED DESCRIPTION OF PREFERRED EMBODIMENTS

The present invention will now be described with reference to the drawings.

Figure 1:
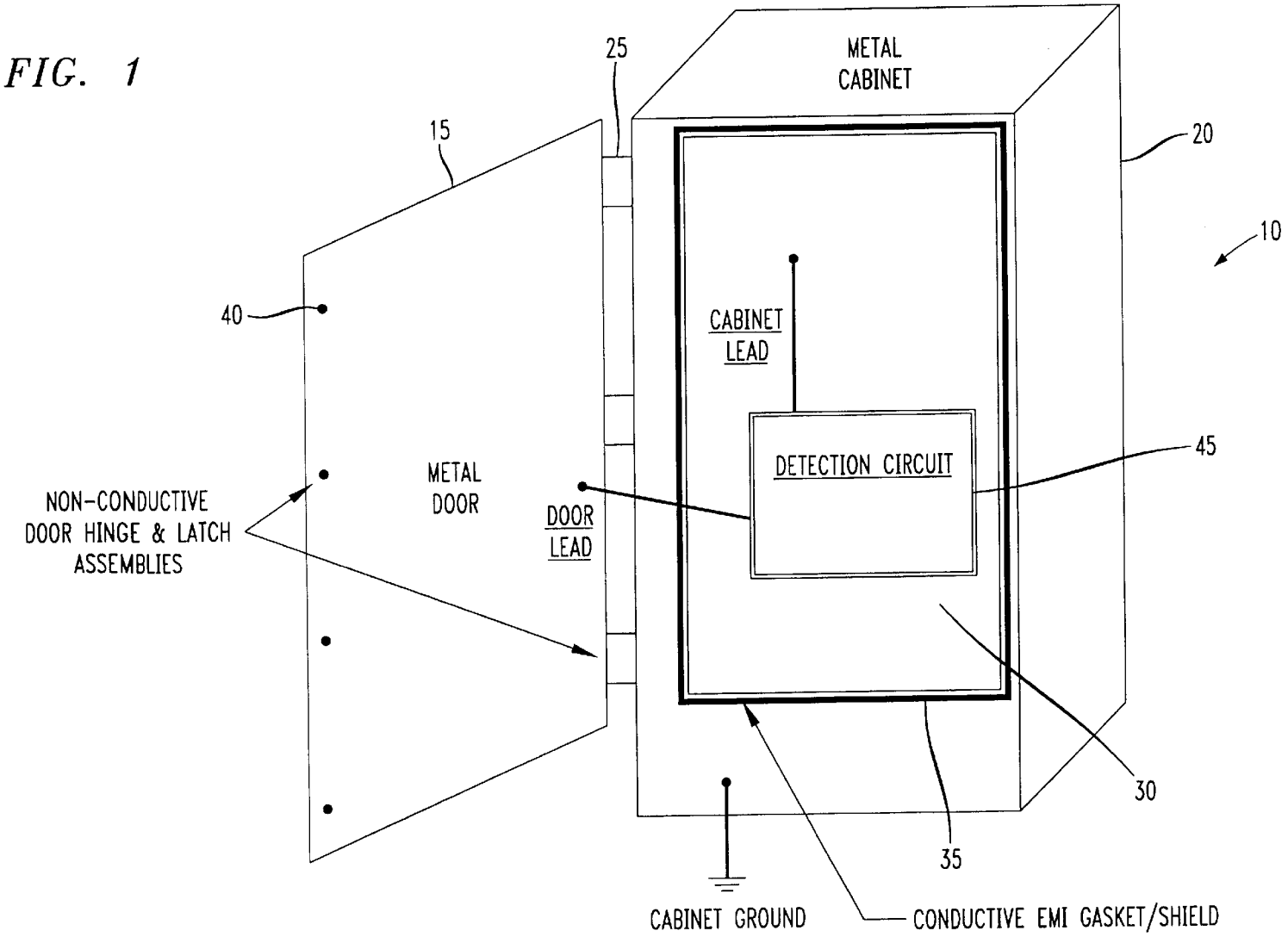
FIG. 1 is a diagram showing a cabinet sealed with an EMI gasket in accordance with a preferred embodiment of the invention.

FIG. 1 shows a metal cabinet 10 used in the present invention. Cabinet 10 is typically used for storing telecommunications equipment, such as cellular equipment for a base station. The cabinet includes a metal door 15, attached to the metal cabinet body 20 by non-conductive hinges 25. The cabinet body 20 has an opening on the front side in the form of a window area 30. A conductive EMI gasket 35 is placed around the outer edge of window area 30. This gasket prevents leakage of electromagnetic radiation into and from the cabinet body 20. The gasket can be made of any suitable conductive elastomer type material. Conductive elastomers are efficient as gaskets because they provide electrical shileding as well as weatherproofing functions. Alternatively, the gasket can be made of a material such as beryllium copper finger stock, if weatherproofing is not required. The door 15 includes non-conductive latch members 40 along its outer edge for securing the door 15 to the cabinet housing 20. As a result of the non-conductive hinges 25 and latch members 40, when door 15 is closed it is electrically connected to cabinet body 20 only through the EMI gasket 35.

A detection circuit 45 is connected to the door 15 and the cabinet body 20 and serves to detect changes in the resistance of the gasket 35.

Typically, the cabinet 10 is located at a cellular base station. A remote operator, located at a cellular switching station or other remote facility, monitors the net resistance of the gasket 35 via a radio signal (e.g. elements 61,61',71, and 71' of FIGS. 2 and 3) or a landline transmitted signal. By doing so, the remote operator can determine if the cabinet 10 is or has been tampered with. If someone attempts to forcibly open cabinet 10, a portion of the door detaches from the gasket 35, thereby breaking a portion of the contact between the door 15 and the cabinet body 20. This is registered as a deviation, i.e. increase, in the resistance of the gasket. When the net gasket resistance deviates from its normally specified value, the operator will be alerted to the opening of the door 15.

Figure 2:
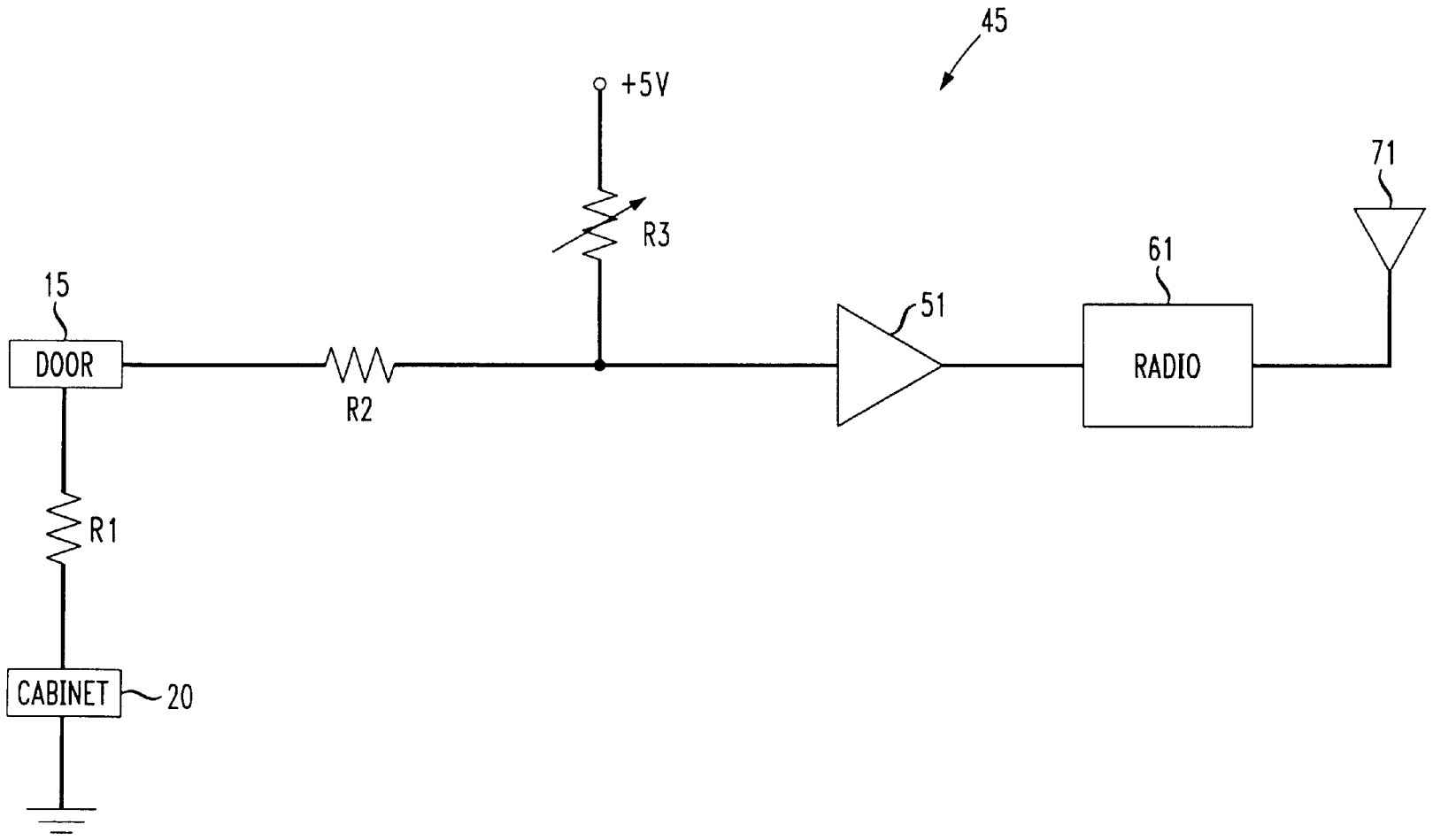
FIG. 2 is a circuit diagram showing a first embodiment of a resistance monitoring circuit used with the gasket arrangement shown in FIG. 1.

FIG. 2 shows a first embodiment of a detection circuit 45 for monitoring the resistance of the door gasket. As shown in FIG. 2, a gasket resistance R1 is connected between the door 15 and the cabinet body 20. This resistance R1 is calculated by multiplying the ohms (Ω) per foot of the material used for the gasket 35 by the number of feet of material used. The detection circuit 45 further includes another resistor R2 and a potentiometer R3. The potentiometer is connected to a 5 volt source. Variation of the potentiometer R3 allows the sensitivity of the detection circuitry to be altered. The value of the potentiometer R3 should be chosen such that:

$$R3 \cong 0.15(R1+R2)$$

Choosing such a value for R3 allows proper detection of changes in the gasket resistance R1. The circuit 45 provides a signal to a Schmitt trigger circuit 51, or other logic circuit, which provides a "0" or "1" output signal depending on whether the value of the resistor R1 exceeds a threshold value. When the door 15 is connected to the cabinet body 20 through the resistance R1, the detecting circuit 45 normally provides a signal of approximately 0.8 volts or lower to the Schmitt trigger 51, which, in turn, provides a logic "0" output. If the Schmitt trigger 51 detects a voltage of 0.8 volts or higher, it will output a logic "1", indicating that the net gasket resistance has been changed from its normal state to an abnormal state. It should be understood that if any portion of the door becomes separated from the cabinet, the gasket resistance R1 is changed. As more of the door is separated from the cabinet the resistance R1 increases, until, when the door and the cabinet are completely separated, the resistance becomes infinite. The creation of this infinite resistance causes the current to want to flow from the 5 volt source directly to the Schmitt trigger 51. This, in turn causes approximately a 5 volt bias to appear at the input to the Schmitt trigger 51, since the resistance R1 is no longer present to drop the voltage, and the drop across R2 is negligible. Therefore, the voltage values which occur between 0.8 volts and 5 volts all indicate at least a partial degree of separation of the door from the cabinet. By having the Schmitt trigger 51 output a logic "1" whenever a value in excess of 0.8 volts is received, the net gasket resistance can be effectively monitored, and intrusion into the cabinet can be reliably detected.

The circuit of FIG. 2 also includes a radio 61 and an antenna 71 for transmitting the output signal from the Schmitt trigger 51 to the remote operator. However, radio circuitry is not required, and the output signal of the Schmitt trigger 51 may be sent by a landline or electro-optical connection.

Figure 4:
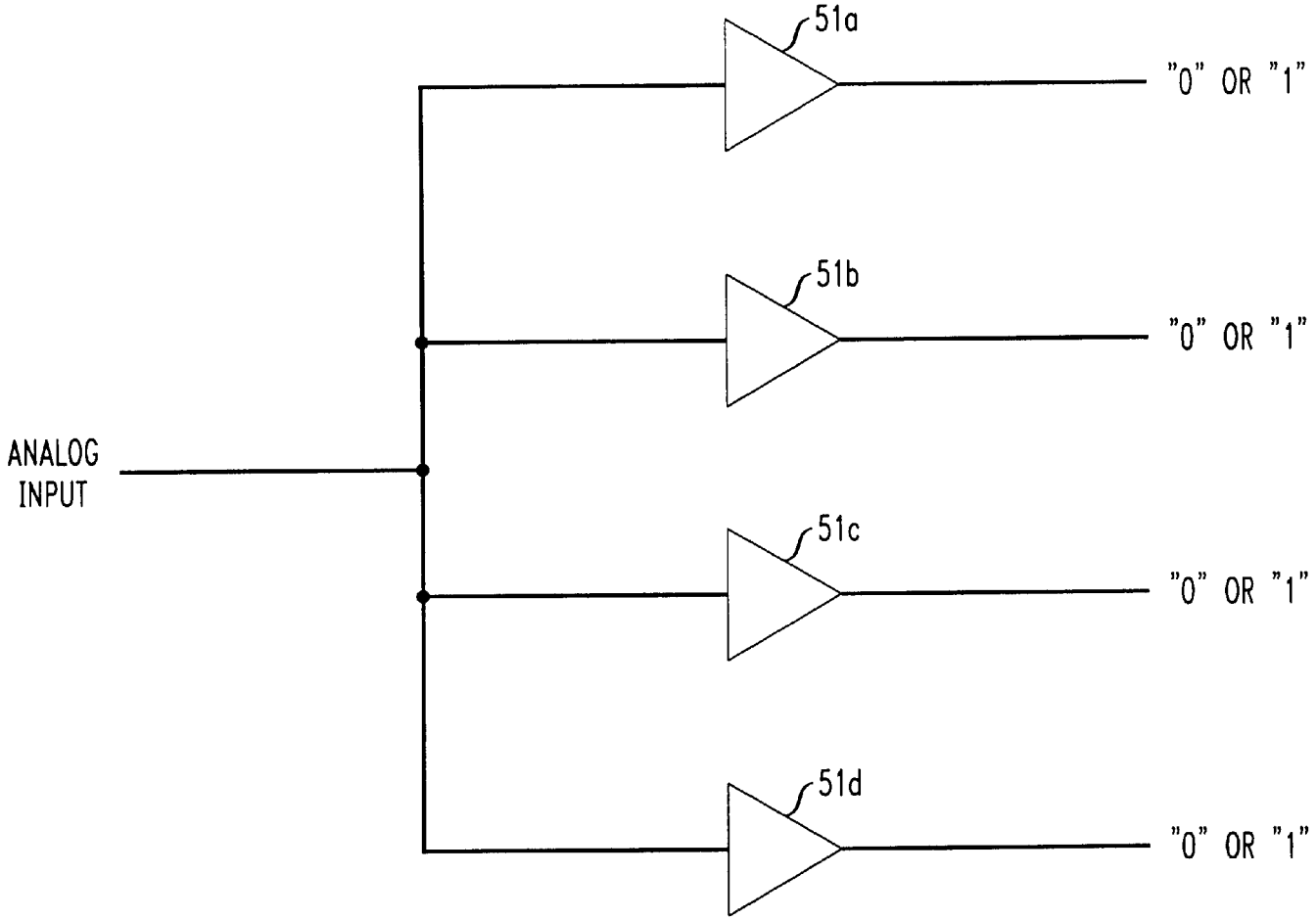
FIG. 4 is a circuit diagram showing a modification of the resistance monitoring circuits shown in FIGS. 2 and 3.

As shown in FIG. 4, Schmitt trigger 51 can also be replaced by a parallel array of such circuits with differing and increasing threshold voltage values to sense different values of the resistance R1, if desired. For example, Schmitt trigger 51*a* could be set for a 0.8 volt threshold, trigger 51*b* with a 2 volt threshold, trigger 51*c* with a 3.2 volt threshold, and trigger 51*d* with a 4.4 volt threshold. The collective parallel output from 0000 to 1111 would form a multi-bit pattern, e.g., a pattern indicative of the degree of separation of the door 15 from the cabinet body 20.

Figure 3:
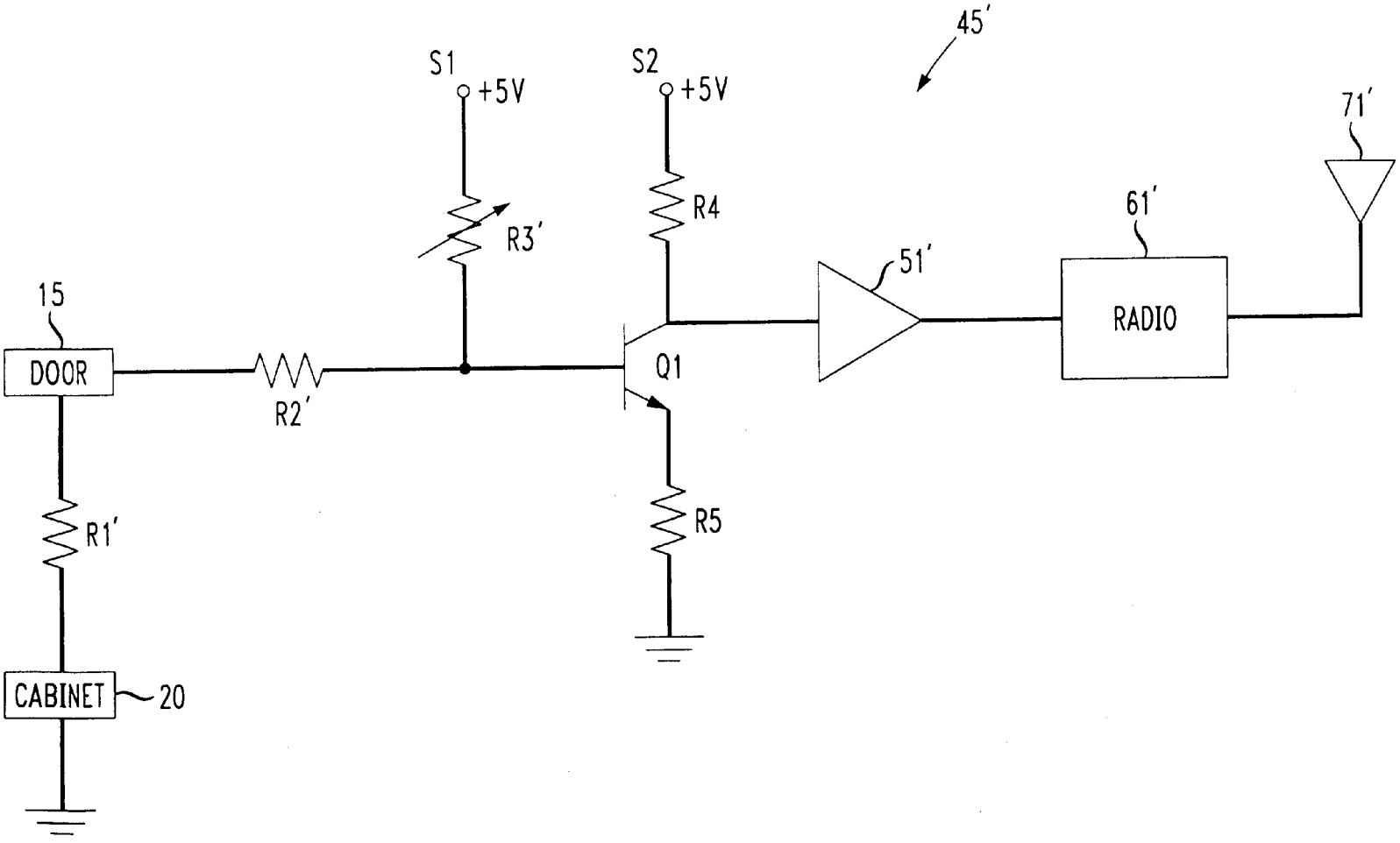
FIG. 3 is a circuit diagram showing a second embodiment of a resistance monitoring circuit used with the gasket arrangement shown in FIG. 1.

FIG. 3 shows a second embodiment of a circuit 45' for monitoring the resistance of the door gasket 35. The circuit 45' shown in FIG. 3 differs from the previous embodiment of FIG. 2 in that it detects a change in gasket resistance as a logic "0", rather than as a logic "1". As with FIG. 2, the circuit includes a gasket resistance R1' located between the door and the cabinet, as well as a resistance R2' and a potentiometer R3', connected to a 5 volt source S1. However, the FIG. 3 circuit further includes a n-p-n transistor Q1, and two additional resistors R4 and R5 connected to the collector and emitter of the transistor, respectively. Under normal operating conditions (i.e. when the door is secured completely against the cabinet body), the detecting circuitry 45' receives approximately 5 volts from source S2, because the transistor Q1 is biased "OFF". When the door becomes separated from the cabinet, less of the voltage from 5 volt source S1 is dropped across the gasket resistance R1', and therefore, more voltage appears at the gate of the transistor Q1. This increased voltage at the gate of the transistor Q1 causes transistor Q1 to turn "ON", and thereby prevents the 5 volt source S2 from applying a voltage signal to the Schmitt trigger 51'. The Schmitt trigger 51' therefore registers a logic "0" at its output, and intrusion is detected. The circuit of FIG. 3 also includes a radio 61' and an antenna 71', but as stated above in reference to FIG. 2, these elements are not required. As with FIG. 2, a multi-level threshold circuit could also be used to provide added information on the degree of separation between door 15 and cabinet body 20.

The output of the detection circuit 45(45') whether in digital or analog form can be sent to the remote operator by using the output(s) of Schmitt trigger 51 to suitably modulate a characteristic, e.g., amplitude, frequency, phase, of a radio wave sent from the base station to the remote operator. Alternatively the output of the detection circuit 45(45') could also be sent to the remote operator by a hard wired circuit, or an electro-optical link.

The invention also provides for a reliable method of monitoring the integrity of the gasket 35, so that when the gasket is no longer operating at peak efficiency, it can be replaced. Since the net gasket resistance will increase when the gasket 35 becomes worn or ineffective, the detecting circuit 45(45') can also register this change. Hence, when the operator detects a change in net gasket resistance, he can order replacement of gasket 35.

Although the FIGS. 2 and 3 detection circuits 45 and 45' supply digital logic levels as signals which indicate the status of the opening of the door 15 to a radio or other communication equipment for transmission to a remote operator, it is also possible to supply the output signal at the junction of resistors R2 and R3 as an analog signal into the radio or other communication equipment as a modulating signal to provide a continuous analog representation of the state of door 15 relative to cabinet body 20 to the remote operator.

Although the present invention has been described with reference to a telecommunications cabinet located at a cellular base station, it should be understood that the invention can be used with any outdoor cabinet housing electrical or other equipment. For instance, power companies and cable companies use similar outdoor cabinets, and the present invention could be suitably modified for those applications as well as others.

Although preferred embodiments of the invention have been described and illustrated, it should be readily understood that the invention is not limited to those described and illustrated embodiments. Rather, the invention can be modified to incorporate any number of variations, alterations, substitutions or equivalent arrangements not heretofore described, which are commensurate with the spirit and scope of the invention. Accordingly, the invention is not limited by the foregoing description, but is only limited by the scope of the appended claims.

What is claimed as new and desired to be protected by Letters Patent of the United States is:

1. An intrusion detection system comprising:

a container which encloses electrical equipment;

a door connected to said container for allowing access to said electrical equipment;

a gasket located between the door and the container which reduces the ingress and egress of electromagnetic radiation into and from said container, said gasket having an associated resistance value; and, a circuit for monitoring the resistance value of said gasket to determine if the door has become at least partially separated from the container.

2. The system of claim 1, wherein the container is an outdoor equipment cabinet.

3. The system of claim 1, wherein the door is connected to the container by non-conductive hinges and latches.

4. The system of claim 1, wherein the gasket is made from a conductive elastomer.

5. The system of claim 1, wherein an electrically conductive path is formed between the door, the gasket, and the container in which a current can flow.

6. The system of claim 5, wherein at least partial opening of the door disturbs the current flow through the electrically conductive path.

7. The system of claim 1, wherein said monitoring circuit monitors said resistance value to determine whether the door is open or closed.

8. The system of claim 1, further comprising communications equipment for transmitting a signal representing the output of said monitoring circuit to a location remote from the container.

9. The system of claim 8, wherein said communications equipment comprises a radio.

10. The system of claim 1, wherein the monitoring circuit comprises:

a voltage source of a first potential;

a resistor having its one end connected to the door;

a potentiometer connected between the other end of the resistor and the voltage source; and the container being connected to a voltage source of a second potential, whereby a voltage divider is formed between said first and second potential by said potentiometer, resistor, and resistance value of said gasket.

11. The system of claim 10, wherein the monitoring circuit further includes a digital logic circuit connected at the junction of said potentiometer and resistor.

12. The system of claim 11, wherein the digital logic circuit comprises at least one Schmitt trigger.

13. The system of claim 11, wherein the digital logic circuit comprises a plurality of Schmitt triggers having respective operative threshold levels.

14. The system of claim 10, wherein the monitoring circuit further includes a means of transmitting the analog output signal taken at the connection between the resistor and the potentiometer to a remote location.

15. The system of claim 1, wherein the circuit further includes:

a voltage source of a first potential;

a first resistor having its one end connected to the door;

a potentiometer connected between the other end of the first resistor and the voltage source;

the container being connected to a voltage source of a second potential, whereby a voltage divider is formed between said first and second potential by said potentiometer, said first resistor, and said resistance value of said gasket;

a transistor, including a collector terminal, an emitter terminal and a gate terminal, connected in series with the first resistor;

a second resistor connected between a second voltage source of a third potential and the collector terminal of the transistor; and, a third resistor connected between the emitter terminal of the transistor and ground.

16. The system of claim 15, wherein the monitoring circuit further includes a digital logic circuit connected to one of the terminals of the transistor.

17. The system of claim 16, wherein the digital logic circuit comprises at least one Schmitt trigger.

18. The system of claim 16, wherein the digital logic circuit comprises a plurality of Schmitt triggers having respective operative threshold levels.

19. The system of claim 15, wherein the monitoring circuit further comprising circuitry for transmitting an analog output signal, taken from one of the terminals of the transistor, to a remote location.

20. A method of detecting the unauthorized opening of a door comprising the steps of:

providing a gasket located between a frame and a door, said gasket having a resistance value; and monitoring the resistance of said gasket to determine if the door has been at least partially separated from the frame.

21. The method of claim 20, wherein an electrical path is formed between the frame, the gasket, and the door, in which current can flow.

22. The method of claim 21, wherein at least partial opening of the door disturbs the current flow through the electrically conductive path.

23. The method of claim 20, wherein said gasket is made from a conductive elastomer and is capable of suppressing EMI.

24. The method of claim 20, wherein said step of monitoring comprises monitoring said resistance value to determine whether the door is open or closed.

25. The method of claim 20, further comprising the step of:

transmitting a signal representing the output of said monitoring step to a location remote from the container.

26. The method of claim 25, wherein said transmission is by a radio transmitter.

27. An intrusion detection system comprising:

a frame;

a door connected to said frame;

a gasket interposed between said frame and said door which reduces the ingress and egress of electromagnetic radiation through said frame, said gasket having an associated resistance value; and, a circuit for monitoring the resistance value of said gasket to determine if the door is secured against the frame.

28. The system of claim 27, wherein the door is connected to the frame by non-conductive hinges and latches.

29. The system of claim 27, wherein the gasket is made from a conductive elastomer.

30. An intrusion detection system comprising:

a container;

a door connected to said container for allowing access inside said container;

a gasket located between the door and the container; and, a circuit for monitoring the resistance value of said gasket to determine if the door has become at least partially separated from the container.

* * * * *